United States Patent [19]

Moore

[11] Patent Number: 4,616,830

[45] Date of Patent: Oct. 14, 1986

[54] ROLLING HOOP GAME

[76] Inventor: Arnold R. Moore, 5901 Craig Rd., Box 54, Durham, N.C. 27712

[21] Appl. No.: 776,783

[22] Filed: Sep. 17, 1985

[51] Int. Cl.[4] ..... A63F 3/00

[52] U.S. Cl. ..... 273/126 R; 446/450; 273/129 L

[58] Field of Search ..... 273/126 R, 128 A, 129 R, 273/129 L, 129 M; 446/450, 451, 452, 453

[56] References Cited

U.S. PATENT DOCUMENTS

| | | | |
|---|---|---|---|
| 3,001,324 | 9/1961 | Walker | 446/450 |
| 3,078,620 | 2/1963 | Fryer, Jr. et al. | 446/450 |
| 3,135,514 | 6/1964 | Ahrent | 273/126 R |
| 3,531,889 | 10/1970 | Poole | 446/450 |
| 3,575,416 | 4/1971 | Cooper | 273/126 R |
| 3,604,149 | 9/1971 | Salontai | 273/126 R |
| 4,091,564 | 5/1978 | Janeski | 273/126 R |
| 4,257,189 | 3/1981 | Hensley | 446/450 |

*Primary Examiner*—Richard C. Pinkham
*Assistant Examiner*—T. Brown
*Attorney, Agent, or Firm*—Lynn E. Barber; Paul Overhauser

[57] ABSTRACT

The invention is a game comprising a shaft having a U-hook at one end, a small wheel, and at least two marking pegs. The wheel is placed on the floor or ground on its edge, and the U-hook is placed around the lower portion of the wheel. A player holds the end of the shaft opposite the U-hook, and pushes the wheel, causing it to roll. Great skill and dexterity must be used to keep the wheel from tipping over and falling out of the U-hook while it is rolling. The player(s) who are able to keep the wheel rolling for the longest distance win. Marking pegs are used to designate distances or set courses the wheel must traverse.

4 Claims, 4 Drawing Figures

ROLLING HOOP GAME

FIELD OF THE INVENTION

This invention relates generally to games and more particularly pertains to a wheely-hoop game involving the guiding of a rolling wheel on a game course using a hook located on the end of a shaft.

BACKGROUND OF THE INVENTION

Games involving the moving of rolling objects to particular points on a course generally utilize the propulsion of spherical balls with mallets and players only have sporadic control over the movement of the ball. The players are not able to maneuver the ball with any great amount of precision. In addition, such games are usually not adaptable for indoor play.

OBJECTS OF THE INVENTION

One object of the present invention is to provide a game wherein players have an opportunity to utilize skill and coordination to maneuver movement of a rolling wheel.

Another object of the invention is to provide a game which may be played either indoors or outdoors, and which does not necessitate the use of dangerous instrumentalities such as bats or pointed objects.

Another object of the invention is to provide a game which can be inexpensively constructed.

Still other objects and advantages of the invention will become apparent to those of skill in the art after reading the following description of a preferred embodiment.

SUMMARY OF THE INVENTION

This invention allows players to maneuver a rolling wheel along a set course with substantial continuous control and precision. Players are free to establish a course consistent with their personal skill and desires. At the beginning of the course, a small wheel is placed on the ground and held in an upright position by the use of a U-hook located on the end of a shaft. The player pushes the shaft at the opposite end, causing the wheel to roll. The object of the game is to keep the wheel rolling along the course and not have it tip over. The player or team of players who can keep the wheel rolling the longest distance over the course is the winner.

DESCRIPTION OF THE INVENTION

The present invention comprises a wheel, a guiding shaft with a U-hook at one end, the curvature of the hook being designed to partially surround the sides and one edge of the wheel, and marking pegs to be placed on a game course. The sides of the U-hook act to keep the wheel from tipping over on its side while it is rolling.

The width between the arms of the U-hook should wide enough so that it prevents the wheel from tipping over when the U-hook is placed around the wheel at its centerline. However, the width between the arms must not be so narrow that the wheel cannot freely rotate. In addition, the angle at which the U-hook is positioned with respect to the shaft should be variable. This feature allows the U-hook to be adjusted to accommodate any particular player's height or preferred method of rolling the wheel.

By moving the shaft in a direction towards the wheel, the U-hook pushes the wheel causing it to roll. Care must be taken not to position the U-hook too low on the wheel, or else the wheel will easily tip over when pushed. Likewise, the U-hook can not be placed too high on the wheel, or else the wheel will not roll when pushed. If the wheel is pushed too quickly, it is likely to roll out of the U-hook and fall over. However, if the wheel is pushed too slowly, then the lack of inertia may also cause the wheel to tip over. These factors result in a game which requires great skill and dexterity to master.

DETAILED DESCRIPTION OF THE DRAWINGS

Figure 2:
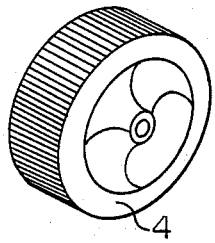
FIG. 2 is a perspective view of a wheel.
Figure 1:
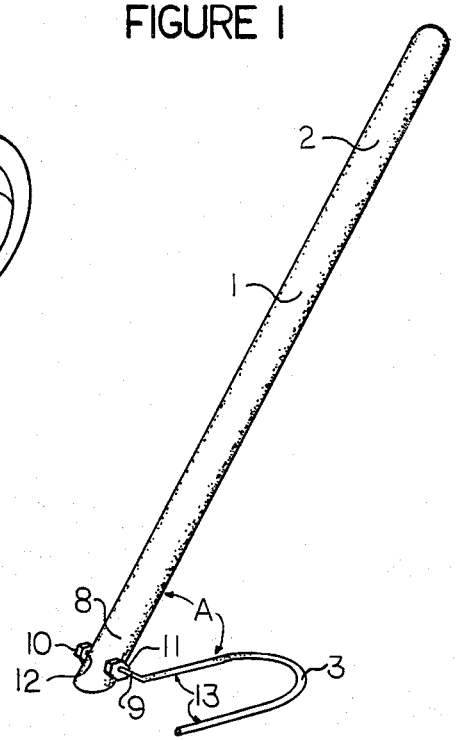
FIG. 1 is a perspective view of a guiding shaft having a U-hook disposed at one end thereof.

FIG. 1 shows a guiding shaft 1. In the preferred embodiment, the guiding pole 1 comprises an upper end 2 and lower end 8 having a hole through it (not shown). Guiding shaft 1 must be of a sufficient length to extend from a player's downstretched hand to the ground, or about thirty (30) inches. Guiding shaft may be constructed of any relatively lightweight material, such as wood. Curved U-hook 3 is attached to lower end 8 of guiding shaft 1. Such attachment is accomplished by inserting a threaded and perpendicularly disposed end 9 of U-hook 3 through the hole in the lower end 8 of guiding shaft 1. Nuts 10 and 11 are positioned on both sides of said lower end 8, and are threaded on the threaded and perpendicular disposed end 9 of U-hook 3. A lock washer 12 is located between nut 10 and said lower end 8. Nut 10 should be screwed loosely enough to allow U-hook 3 to to swivel in order to adjust the angle between U-hook 3 and guiding shaft 1, indicated as A.

Figure 4:
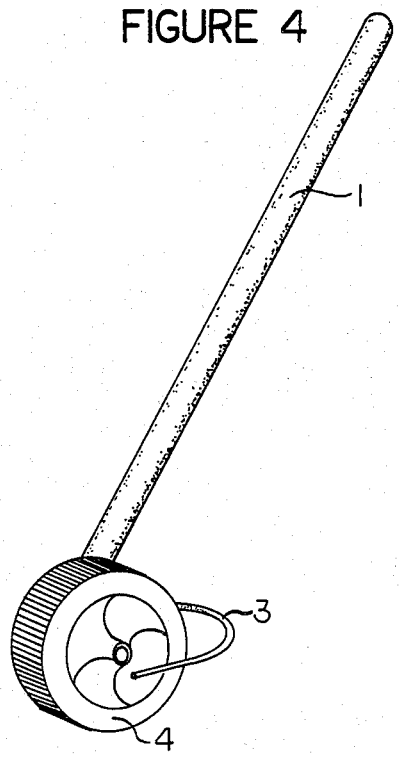
FIG. 4 is a perspective view of the guiding shaft and U-hook positioned around the wheel.

The curvature of hook 3 is designed to partially surround a wheel 4, shown in FIG. 4. In the preferred embodiment, the wheel 4 may have a diameter of six (6) to twelve (12) inches and a width of one (1) to four (4) inches. The distance between the arms 13 of U-hook 3 must be greater than the width of wheel 4.

Figure 3:
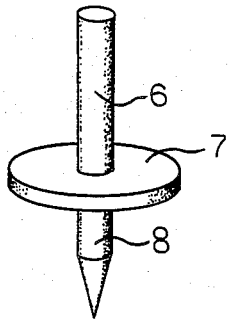
FIG. 3 is perspective view of a marking peg.

FIG. 3 shows a preferred embodiment of a marking peg comprising an upright portion 6, a base 7 and a lower portion 8. Two or more marking pegs may be placed on the floor or ground to indicate a course to traverse using the guiding shaft 1 and wheel 4.

Opposing players or teams of players can compete by using guiding shaft 1 to maneuver a wheel 4 toward and around two or more marking pegs designating a course. The players in turn endeavor to maintain the wheel upright for a maximum distance along the course. The player or team that is able to roll the wheel the farthest without having it tip over is the winner.

I claim:

1. A wheely-hoop game, comprising, in combination:

(a) a set of at least two marking pegs;

(b) a wheel having a circumferential edge, and further having a center of gravity such that it is substantially incapable of standing on its circumferential edge by itself;

(c) a guiding shaft having an upper end and a lower end, said lower end having a hole passing diametrically therethrough; and (d) a U-hook having a first arm and a second arm, the end of said first arm being threaded and disposed in a perpendicular manner to the rest of said first arm but in a manner coplanar with said first and second arms;

said arms of said U-hook being of a length no greater than the diameter of said wheel;

said first and second arms being separated by a distance no less than the width of said wheel and no greater than the diameter of said wheel; and the threaded end of said first arm passing through the diametrical hole in the lower end of said guiding shaft, and further being secured thereto.

2. The wheely-hook game according to claim 1, wherein the angle of said U-hook in relation to said guiding shaft may be adjusted.

3. The wheely-hoop game according to claim 1 wherein the guiding shaft is comprised of cylindrically shaped wood.

4. The wheely-hoop game according to claim 1 wherein each marking peg is comprised of a base, an upwardly extending member perpendicular to said base, and a downwardly extending member perpendicular to said base in a direction opposite from said upwardly extending member, said downwardly extending member coming to a point whereby it is capable of being inserted into soil.

* * * * *